United States Patent [19]

Werner

[11] Patent Number: 4,730,087

[45] Date of Patent: Mar. 8, 1988

[54] EXPLOSIVELY-OPERATED ELECTRICAL CONNECTOR

[75] Inventor: Walter M. Werner, Downingtown, Pa.

[73] Assignee: AMP Incorporated, Harrisburg, Pa.

[21] Appl. No.: 944,473

[22] Filed: Dec. 19, 1986

[51] Int. Cl.[4] ..... H01R 4/08

[52] U.S. Cl. ..... 174/94 S; 174/94 R; 403/314; 403/374

[58] Field of Search ..... 174/90, 94 R, 94 S; 29/421 E; 339/273 R, 273 F, 275 E, 276 E; 403/314, 374; 24/136 R, 136 L, 132 WL, 134 L

[56] References Cited

U.S. PATENT DOCUMENTS

| | | | |
|---|---|---|---|
| 1,801,277 | 4/1931 | Kelley | 339/247 |
| 3,235,944 | 2/1966 | Broske et al. | 174/90 |
| 3,257,499 | 6/1966 | Broske | 174/94 R |
| 3,304,962 | 2/1967 | Broske | 140/113 |
| 3,761,602 | 9/1973 | De Sio et al. | 174/90 |
| 4,128,058 | 12/1978 | Mixon, Jr. et al. | 102/202.14 |
| 4,252,992 | 2/1981 | Cherry et al. | 174/90 |
| 4,600,264 | 7/1986 | Counsel | 339/247 |

*Primary Examiner*—Morris H. Nimmo
*Attorney, Agent, or Firm*—Allan B. Osborne

[57] ABSTRACT

An explosively operated electrical connector for mechanically gripping and electrically interconnecting a pair of electrical cables. More particularly, the connector includes a C-member with converging, inwardly facing channels, a complementary wedge member and an explosively driven ram positioned in a housing on the C-member for driving the wedge member into wedging engagement with cables positioned in the channels.

7 Claims, 5 Drawing Figures

EXPLOSIVELY-OPERATED ELECTRICAL CONNECTOR

FIELD OF THE INVENTION

This invention relates to electrical connectors used to mechanically and electrically interconnect overhead electrical transmission and distribution cables. More particularly, it is concerned with connectors of the type including a C-shaped member and complementary wedge member which is driven into the former explosively to mechanically grip and electrically interconnect two cables.

BACKGROUND OF THE INVENTION

Electrical connectors of the type having a C-member with converging channels and a complementary wedge member to mechanically grip and electrically interconnect two electrical cables are well known in the art. The cables are gripped and interconnected electrically by driving the wedge member into the C-member to wedge the cables tightly in the channels.

Three methods of driving the wedge member into the C-member have been disclosed. One method, disclosed in U.S. Pat. Nos. 1,801,277 and 4,600,264, uses a bolt threadly attached to the C-member to drive the wedge. A second method, disclosed in U.S. Pat. No. 3,212,534, uses a tool having an explosively driven ram for driving the wedge. In the third method, disclosed in U.S. Pat. Nos. 3,257,499 and 3,304,962, an explosive charge in the wedge member cooperates with a stationary member to drive the wedge member into the C-member.

It is now proposed to provide an explosive charge and sliding ram in a housing on the C-member to drive the wedge member into engagement with the electrical cables positioned in the converging channels of the C-member.

SUMMARY OF THE INVENTION

Accordng to the invention, an electrical connector is provided which includes a C-member with inwardly converging channels, a housing positioned between the channels containing a ram and an explosive unit for driving the ram from the housing. Further included is a wedge member slidably positioned in the C-member for being driven by the ram into wedging engagement with cables positioned along the channels.

DESCRIPTION OF THE INVENTION

Figure 1:
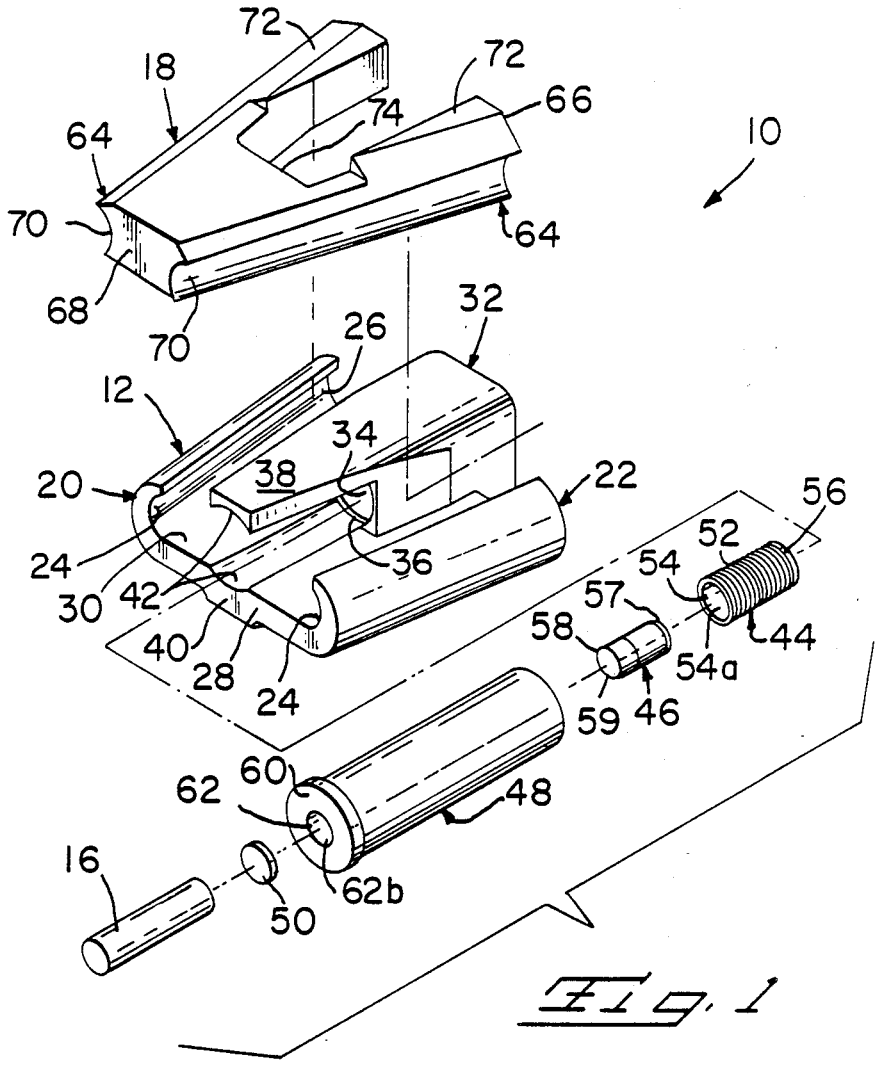
FIG. 1 is an exploded, perspective view of the electrical connector of the present invention showing the components thereof.

As shown in FIG. 1, electrical connector 10 of the present invention includes C-member 12, ignitor assembly 14, ram 16 and wedge member 18.

C-member 12 has opposing arcuate portions 20, 22 which define inwardly facing channels 24. Arcuate portions 20, 22 and accordingly channels 24 converge from wide end 26 of C-member 12 to narrow end 28. Connecting portion 30 extends between and joins arcuate portions 20, 22.

Housing 32 is positioned on connecting portion 30 at wide end 26 of C-member 12 and is equidistance between arcuate portions 20, 22. Passage 34 extends through housing 32 and includes counterbore 36 at the opening facing narrow end 28 of C-member 12. Projection 38 extends outwardly from housing 32 towards narrow end 28 of C-member 12 and overlies center segment 40 of connecting portion 30. Both projection 38 and segment 40 are provided with facing concave surfaces 42 which are coaxial with passage 34.

C-member 12 is preferrably made from 6061-T-6 aluminum.

Ignitor assembly 14 includes ignitor body 44, propellant carrier 46, chamber 48 and disc-shaped seal 50.

Figure 3:
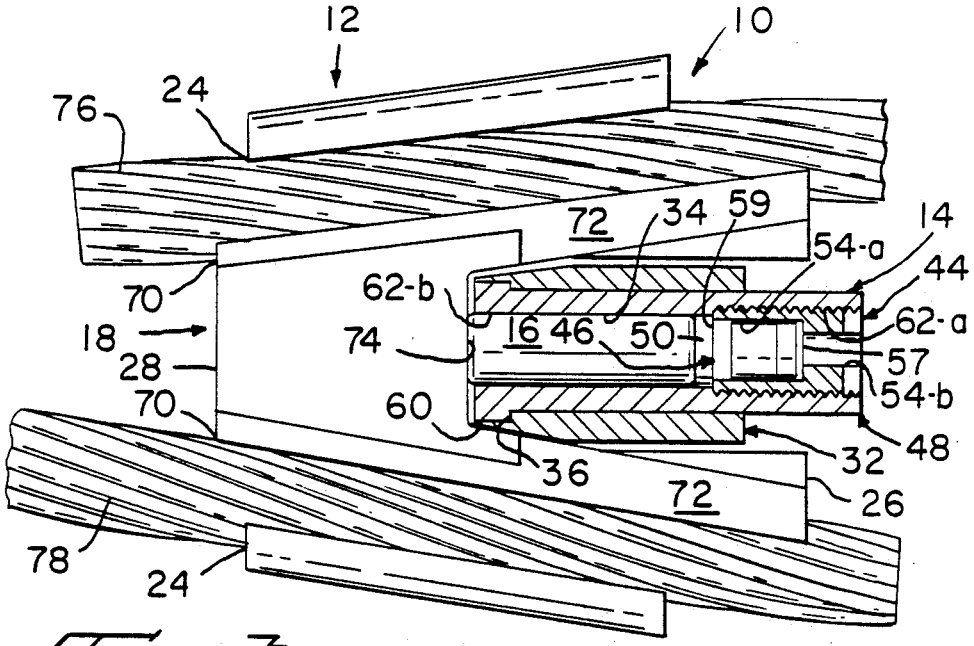
FIGS. 3 and 4 are plan views partly in section showing the electrical connector before and after driving the wedge member into the C-member to mechanically grip and electrically interconnect the pair of electrical cable.

Ignitor body 44, preferrably made from cold drawn steel, has external threads 52 and passage 54 extending longitudinally therethrough. As shown in FIG. 3, passage 54 includes an enlarged section **54-*a* and a smaller section 54-*b*. Slot 56 is provided on one end of body 44. Propellant carrier 46 is hollow and made from nylon. A heating wire (not shown) extends diagonally through carrier 46 with one end exposed at end 57 for engagement with an ignitor (not shown) and the other end exiting from opposite end 58 for engagement with ignitor body 44. Carrier 46 is filled with a propellant such as a powder sold under the tradename INFALLIBLE by the Hercules Powder Company. End 58 of housing 46 is capped by a fusible end cap 59**.

Additional and detailed information concerning ignitor body 44 and propellant carrier 46 is disclosed in U.S. Pat. No. 4,128,058, which is incorporated herein by reference.

Chamber 48, preferrably made form cold drawn steel is an elongated tube with an outwardly projecting annular flange 60 at one end and passage 62 extending longitudinally therethrough. As shown in FIG. 3, passage 62 includes threaded section **62-*a* and smooth-walled section 62-*b***.

Seal 50, as shown in FIG. 1, is preferrably made from a plastic such as polyethylene and has a diameter so as to fit snugly in section **62-*b* of passage 62 of chamber 48**.

Ram 16 is an elongated solid shaft made preferrably from a material such as stainless steel or case hardened steel. The ends may be partially tapered as shown and the diameter is such so as to be slidingly received in section **62-*b* of passage 62**.

Wedge member 18 is preferrably made from 6061-T-6 aluminum. Opposing elongated sides 64 converge from wide end 66 to narrow end 68 of member 18. The arcuate surfaces of sides 64 define outwardly facing channels 70. As shown, a broad notch in wide end 66 of wedge member 18 define a pair of legs 72 with outwardly facing surface 74 therebetween.

Electrical connector 10 is assembled by placing propellant carrier 46 into enlarged section **54-*a* of passage 54 in ignitor body 44 so that the end of the aforementioned heating wire at carrier end 57 is isolated from body 44 and is accessible through smaller passage section 54-*b*. Fusible end cap 59 faces outwardly at the end of body 44 opposite the slotted end. Ignitor body 44 is threaded into threaded section 62-*a* of passage 62 in chamber 48 with fusible end cap 59 facing the smooth walled passage secton 62-*b* as shown in FIG. 3. Seal 50 is positioned against end cap 59 and ram 16 is positioned in smooth wall section 62-*b*. Seal 50 provides a gas-tight seal between end cap 59 and ram 16**.

As shown in FIG. 3, ignitor assembly 14 with ram 16 therein is placed in passage 34 in housing 32 on C-member 12 so that ignition end 57 of propellant carrier 46 is accessible at the wide end 26 of C-member 12 and ram 16 will exit chamber 48 in the direction towards narrow end 28. Flange 60 of chamber 48 is received in counterbore 36 of passage 34 in housing 32.

Figure 2:
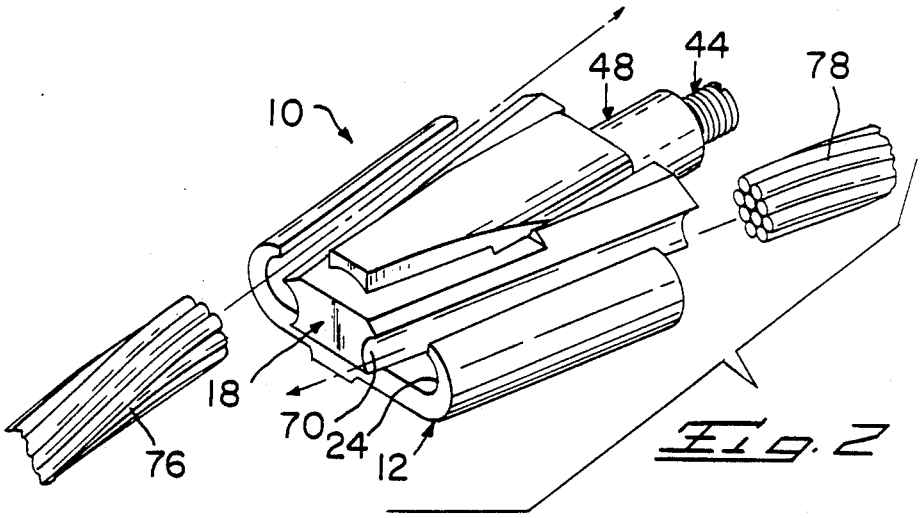
FIG. 2 is a perspective view of the electrical connector assembled and with a pair of electrical cables being inserted thereinto.

Wedge member 18 is conformably placed in C-member 12 so that legs 72 straddle housing 32 and channels 70 face respective channels 24 as shown in FIG. 2. As shown in FIG. 3, ram 16 is against or immediately adjacent surface 74 of wedge member 18.

FIG. 2 shows an assembled electrical connector 10 with cables 76, 78 being inserted into the spaces between pairs of facing channels 24, 70 of members 12, 18 respectively. Alternatively, cables 76, 78 may be positioned in respective channels 24 and wedge member 18 placed in position on C-member 12 thereafter.

The view in FIG. 3 shows cables 76, 78 in place and wedge member 18 positioned for being driven in the direction of narrow end 28 of C-member 12 to mechanically grip cables 76, 78 and provide an electrical interconnection therebetween.

Figure 4:
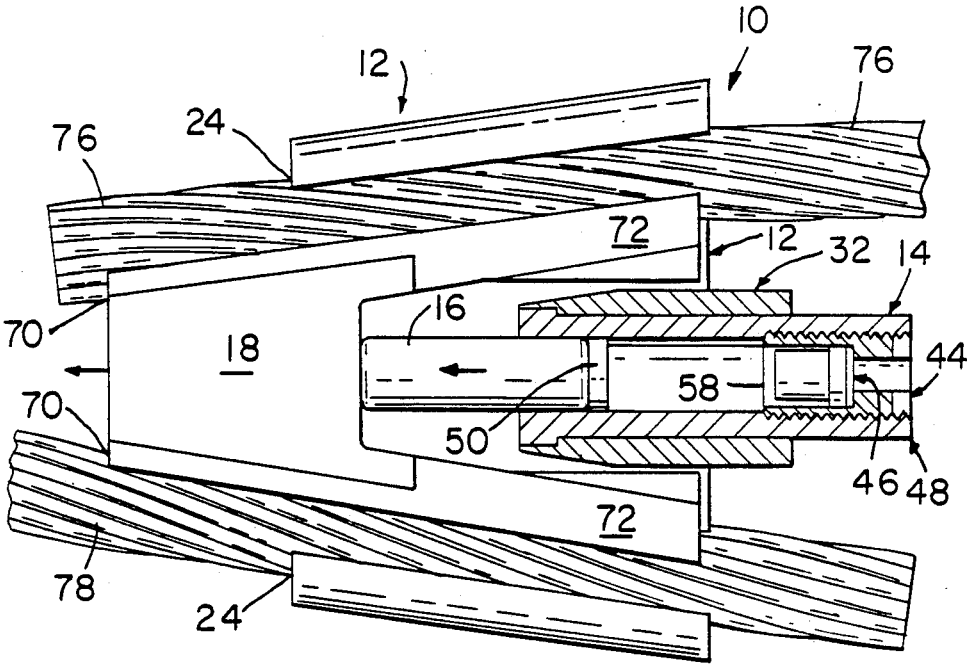

With reference to FIG. 4, wedge member 18 is driven forward by applying an electrical current to the heating wire to ignite the powder in carrier 46. The gases created push on ram 16 which engages and drives wedge member 18. The amount of powder in carrier 46 is predetermined so that wedge member 18 moves forwardly far enough to tightly wedge cables 76, 78 in respective facing channels 24, 70 of members 12, 18 respectively. The burning melts end cap 59 to permit the gases to leave carrier 46 through end 58. Projection 38 provides a means for confining wedge member 18 within C-member 12 during the driving thereof.

After firing, ram 16, seal 50, spent housing 46 and housing 44 may be removed from chamber 48 if desired.

Figure 5:
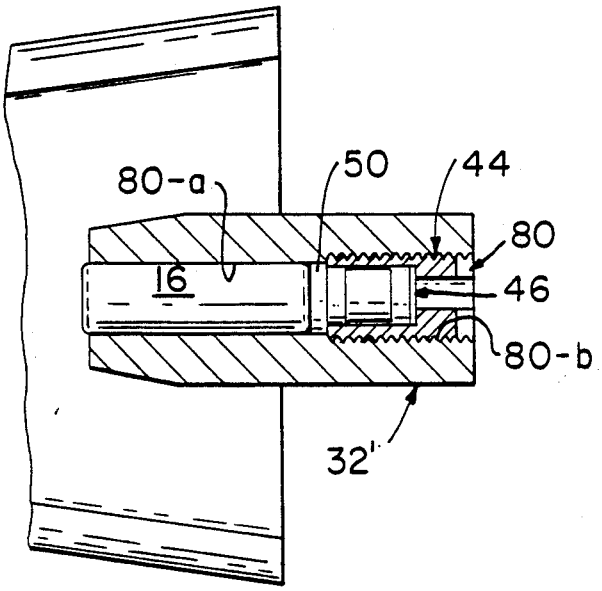
FIG. 5 is a sectional view showing an alternative embodiment of one component of the electrical connector.

An alternative embodiment of housing 32 is shown in Figure 5. Housing 32' is made longer and passage 34 is replaced by a reduced diameter passage 80 having a smooth section **80-*a* for receiving ram 16 and seal 50 and a threaded section 80-*b* for receiving ignitor body 44 with propellant carrier 46. This alternative embodiment eliminates the need for chamber 48**.

As can be discerned, an explosively-operated electrical connector for mechanically gripping and electrically interconnecting two cables has been disclosed. The connector includes a C-member having two facing and converging cable receiving channels and a housing located between the channels. Further included is a complementary shaped wedge member which has outwardly facing channels to cooperate with the C-member channels to receive cables therebetween. An ignitor assembly and ram, positioned in the housing on the C-member, includes a charge of powder which, upon being ignited, pushes the ram out to drive the wedge member into a wedging engagement with the C-member and cables so that the cables are mechanically gripped and electrically interconnected.

I claim:

1. An explosively operated electrical connector for mechanically gripping and electrically interconnecting a pair of cables, comprising:

an elongated, conductive, C-member having spaced apart, inwardly facing channels joined by a connecting portion, said channels converging from a first end towards a second end of said C-member;

a housing positioned on said connecting portion at said first end of said C-member;

a ram movably disposed in said housing;

conductive wedge means having converging sides and adapted for being slidably positioned on said connecting portion between said converging channels and adjacent said ram; and explosive means disposed in said housing for being ignited to push on said ram to drive said wedge means into wedging engagement with cables which may be positioned along respective channels in said C-member.

2. The electrical connector of claim 1 wherein said ram and explosive means are contained in an open-ended chamber positioned in said housing.

3. The electrical connector of claim 2 wherein said chamber is removably received in a passage in said housing.

4. The electrical connector of claim 3 wherein said wedge means includes a notch in one end defining an outwardly facing surface between a length of said sides of said wedge means.

5. The electrical connector of claim 4 wherein said housing is received in said notch when said wedge means are positioned in said C-member and said outwardly facing surface is engagable by said ram.

6. The electrical connector of claim 5 further including confining means to confine the direction of travel of said wedge means when being driven by said ram.

7. The electrical connector of claim 6 wherein said confining means include a projection on said housing extending over said connecting portion to define therebetween a space for receiving said wedge means.

* * * * *